US005294864A

United States Patent [19]

Do

[11] Patent Number: 5,294,864

[45] Date of Patent: Mar. 15, 1994

[54] MAGNETRON FOR MICROWAVE OVEN

[75] Inventor: Gi I. Do, Seoul, Rep. of Korea

[73] Assignee: Goldstar Co., Ltd., Rep. of Korea

[21] Appl. No.: 903,362

[22] Filed: Jun. 24, 1992

[30] Foreign Application Priority Data

Jun. 25, 1991 [KR] Rep. of Korea ..... 9541/1991
Nov. 20, 1991 [KR] Rep. of Korea ..... 19974/1991

[51] Int. Cl.[5] ..... H01J 25/50
[52] U.S. Cl. ..... 315/39.51; 315/39.53
[58] Field of Search ..... 315/39.51, 39.53

[56] References Cited

U.S. PATENT DOCUMENTS 4,129,834 12/1978 Kerstens ..... 315/39.53 X
4,684,845 8/1987 Tsuzurahara et al. ..... 313/341
4,705,989 11/1987 Takada et al. ..... 315/39.51
5,021,713 6/1991 Uesawa et al. ..... 315/39.51

FOREIGN PATENT DOCUMENTS 61-190834 8/1986 Japan ..... 315/39.53
61-288345 12/1986 Japan ..... 315/39.51
62-237637 10/1987 Japan ..... 315/39.51

*Primary Examiner*—Tony M. Argenbright
*Attorney, Agent, or Firm*—Ostrolenk, Faber, Gerb & Soffen

[57] ABSTRACT

A magnetron for a microwave oven comprising a spacer having a disc shape fitted between a lower pole piece and a F-seal supporting the lower pole piece. The spacer has a pair of lead holes through which a center lead and a side lead extend, respectively. At the upper surface of the space, a metal coating is formed which defines an attenuation cavity. The provision of the attenuation cavity makes it possible to remove effectively leaked microwaves. Since the spacer is firmly fitted between the lower pole piece and the F-seal, it is also possible to avoid a lateral vibration of the lead assembly.

6 Claims, 6 Drawing Sheets

MAGNETRON FOR MICROWAVE OVEN

BACKGROUND OF THE INVENTION

1. Field of the Invention

The present invention relates to a magnetron for a microwave oven, and more particularly to a magnetron for a microwave oven wherein a spacer having a disc shape is fitted between a lower pole piece and an F-seal supporting the lower pole piece and provided at its upper surface with a metal coating, thereby removing effectively leaked microwaves and avoiding a lateral vibration of a lead assembly.

2. Description of the Prior Art

Generally, a magnetron for a microwave oven comprises a diode for emitting thermions. Referring to FIG. 1, there is illustrated an example of a conventional magnetron for a microwave oven. As shown in FIG. 1, the magnetron comprises a magnetron body 1, and a filament 2 disposed in the magnetron body 1 and adapted to emit thermions. The magnetron body 1 is disposed in a casing constituted by an upper member 5 of a plate shape and a lower member 6 of a cylindrical shape. The magnetron body 1 also has upper and lower portions protruded beyond upper and lower members 5 and 6, respectively. To seal and support the magnetron body 1, an A-seal member 3 and an F-seal member 4 are provided at the upper and lower portions of the magnetron body 1. The seal members 3 and 4 also function as a magnetic path. Around the filament 2, a vane 7 is placed to receive microwave energy generated when the thermions emitted from the filament 2 are acceleratively rotated in an interaction spacer 9. A strap 16 is also provided for adjusting frequencies of the thermions rotating acceleratively in the interaction space 9. The magnetron also comprises an antenna feeder 8 adapted as a microwave transmission path for guiding microwave energy received by the vane 7 into a cooking chamber. In the casing, upper and lower permanent magnets 10 and 10' are attached to upper and lower members 5 and 6, respectively, to generate a magnetic field. The magnetic field is applied to the interaction space 9, by means of pole pieces 11 and 11'. Around the magnetron body 1, a plurality of cooling fins 12 are disposed which function to release outwardly heat generated at the side of vane 7 and thus cool the interior of magnetron body 1. A center lead 17 and a side lead 18 are connected at their one ends to both ends of the filament 2, respectively, so as to apply electric power to the filament 2. To the other ends of leads 17 and 18, a through type condenser 14 is connected, which functions as a terminal making it possible to apply easily electric power from the outside to the filament 2. A choke coil 15 is also provided to remove conductive noise generated by lead current. The condenser 14 cooperates with the choke coil 15 to enhance a shield effect on conductive noise. Beneath the housing, a filter box 13 is disposed to surround the lower portion of the magnetron body 1. The filter box 13 functions to remove radiation noise emitting through both the center lead 17 and the side lead 18. A spacer 19 is also provided to support both the center lead 17 and the side lead 18. To the lower end of the magnetron body 1, a cathode terminal 20 is mounted. An F-ceramic member 21 is also provided between the F-seal member 4 and the cathode terminal 20.

In this conventional magnetron with the above-mentioned construction, as electric power is applied to the filament 2 via the center lead 17 and the side lead 18, the filament 2 emits thermions which are, in turn, radiated into the interaction space 9. In the interaction space 9, the thermions conduct a cycloidal movement, that is, an accelerated rotation, by axial magnetic fluxes generated from the pole pieces 11 and 11' and an electric field generated between the filament 2 and the vane 7. On the other hand, microwave energy transmitted to the vane 7 is fed into the cooking chamber, via the antenna feeder 8 and a waveguide (not shown) of the oven, thereby heating the food placed in the cooking chamber.

At this time, the magnetron generates microwaves which includes basic frequency of 2.45 GHz and harmful higher harmonics having a frequency corresponding to a multiple of the basic frequency.

Although such microwaves are desired to go to the output part of magnetron, namely, the antenna feeder 8, in actual, a part of the microwaves flows usually toward the inlet part of magnetron, via the center lead 17, the side lead 18 and the cathode terminal 20.

Such a flow of microwaves into the input part of magnetron results in a degradation in efficiency of the magnetron. Furthermore, if excessive microwaves pass through the magnetron, overheating of the magnetron occurs and results in a damage of the choke coil 15 which is of a structure adapted to attenuate the microwaves in its path. Upon being outwardly leaked, this excessive microwaves also may exert a harmful influence on human bodies and cause radio interference for other appliances such as televisions and etc.

In order to avoid such a leakage of microwaves, there has been proposed microwave shielding devices. A typical example of such microwave shielding devices is illustrated in FIG. 2. As shown in the drawing, the microwave shielding device comprises a microwave shielding choke 22 having a certain shape and fixed to the inner wall of F-seal 4.

In this conventional microwave shielding device, the leakage of microwave is effectively prevented by the microwave shielding choke 22. However, the device requires use of a separate jig for fixing the choke 22, which causes a deterioration in workability in the manufacture of magnetrons and an expensive manufacture cost.

On the other hand, since thermions conduct an accelerated rotation in the interaction space 9, a mechanical vibration occurs at the cathode part of magnetron including the filament 2, the center lead 17 and the side lead 18. U.S. Pat. No. 4,684,845 discloses a device for preventing both the center lead and the side lead from vibrating due to such a mechanical vibration and for maintaining a proper space between the center lead and the side lead. In case of the patent, a spacer is mounted to upper portions of the leads.

The spacer serves effectively to hold the leads at their spaced state. If both the leads vibrate laterally at the same time, however, the spacer then vibrates laterally. As a result, a vibration restraining effect is reduced. Moreover, it is required to form a groove for positioning the spacer at a curved portion of the center lead. It is also needed to provide sleeves. These requirements make a deterioration in workability in the manufacture of magnetrons and an increase in manufacture cost.

SUMMARY OF THE INVENTION

Therefore, an abject of the invention is to eliminate the above-mentioned problems encountered in the prior arts and to provide a magnetron for a microwave oven capable of effectively avoiding the leakage of microwaves.

Another object of the invention is to provide a magnetron for a microwave oven capable of effectively restraining vibrations of its lead assembly, thereby avoiding the breaking down of its filament and a disturbance in its interaction space.

Another object of the invention is to provide a magnetron for a microwave oven capable of effectively avoiding the leakage of microwaves and restraining vibrations of its lead assembly, with a simple construction, thereby saving the manufacture cost and improving workability in the manufacture thereof.

In accordance with the present invention, these objects can be accomplished by providing a magnetron for a microwave oven comprising: a shield body; a center lead and a side lead both extending throughout the shield body; upper and lower pole pieces coupled to upper and lower portions of the shield body, respectively, and defining an interaction space therebetween; an F-seal for supporting the lower pole piece; a spacer fitted in a mounting area defined between the F-seal and the lower pole piece and provided with a pair of lead holes through which the center lead and the side lead extend, respectively; and a metal coating provided at the upper surface of the spacer and adapted to define an attenuation cavity, together with the lower pole piece.

The metal coating has a pair of insulating portions for insulating the center lead and the side lead extending from each other. Each insulating portion has a radius which is larger than that of each corresponding lead, by at least 0.1 mm.

In addition to the metal coating at the upper surface, the spacer also has an additional metal coating at the lower surface thereof.

The spacer is of a disc having a tapered peripheral portion and correspondingly, the F-seal has a smoothly curved portion for supporting the tapered portion of the spacer.

Alternatively, the spacer has a vertical peripheral portion which is perpendicular to both the upper and lower surfaces of the spacer and correspondingly, the F-seal has a step for supporting the spacer thereon.

The attenuation cavity which is defined by the lower pole piece and the metal coating of spacer serves to resonate and thus attenuate undesirable higher harmonics therein. As a result, any leakage of microwaves is avoided. Furthermore, since the spacer is fitted at its peripheral portion between the F-seal and the lower pole piece, simultaneous lateral vibrations of both the leads and thus the disturbance in the interaction space can be avoided.

BRIEF DESCRIPTION OF THE DRAWINGS

Other objects and aspects of the invention will become apparent from the following description of embodiments with reference to the accompanying drawings in which:

FIGS. 6A to 6D show a part of a magnetron according to another embodiment of the present invention, wherein FIG. 6A is a sectional view of an F-seal, FIG. 6B a plan view of a spacer, FIG. 6C a sectional view of the spacer and FIG. 6D a sectional view showing the coupling between the F-seal and the spacer.

DESCRIPTION OF THE PREFERRED EMBODIMENTS

Figure 2:
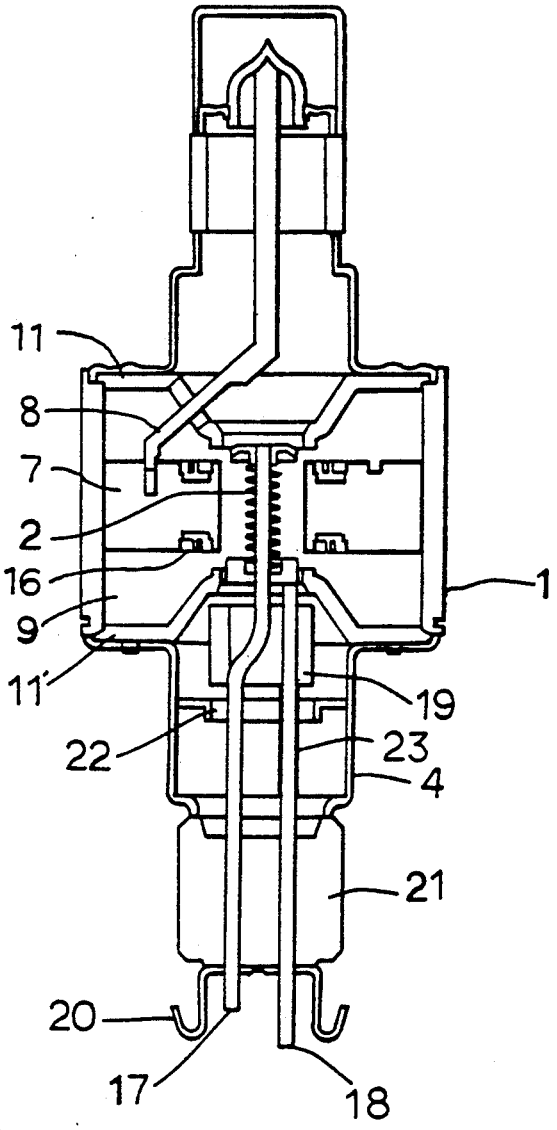
Fig. 2 PRIOR ART
FIG. 2 is a sectional view of a part of another conventional magnetron for a microwave oven.
Figure 3:
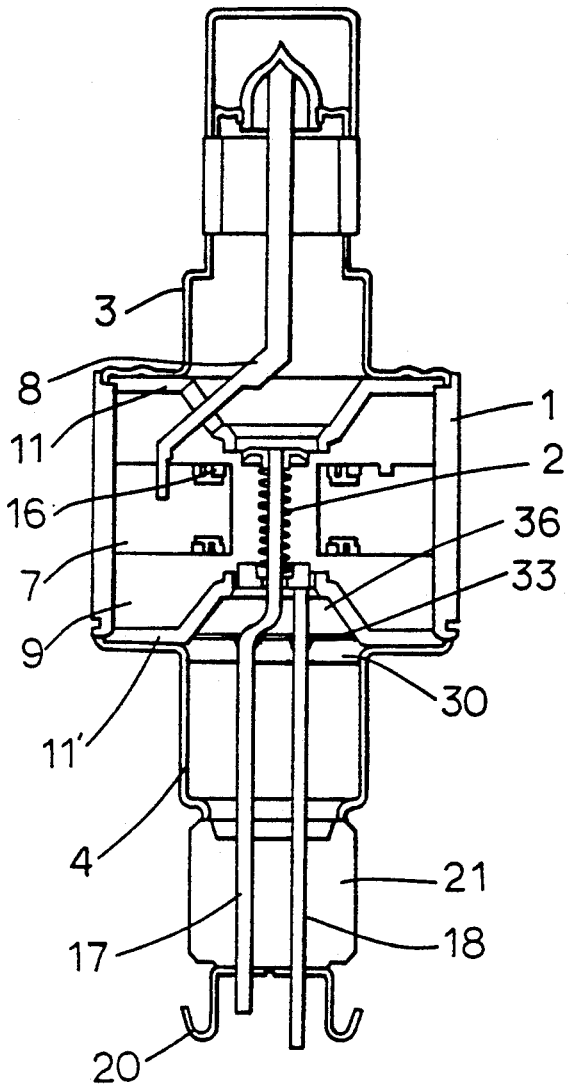
FIG. 3 is a sectional view of a part of a magnetron for a microwave oven according to the present invention.
Figure 4A:
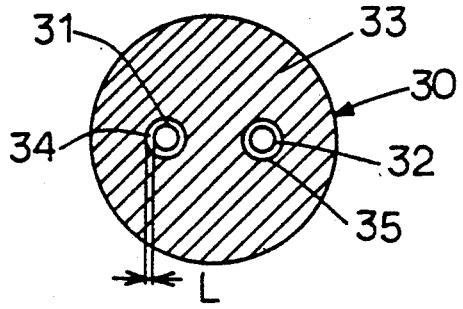
FIG. 4A and 4B are a plan view and a sectional view of a spacer used in the magnetron according to an embodiment of the present invention, respectively.
Figure 4B:
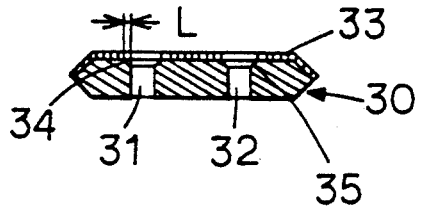

FIG. 3 is a sectional view of a part of a magnetron for a microwave oven according to the present invention. On the other hand, FIGS. 4A and 4B are a plan view and a sectional view of a spacer used in the magnetron according to an embodiment of the present invention, respectively. The magnetron of the present invention has constructions partially similar to those shown in FIG. 2. Accordingly, the same or similar elements are denoted by the same reference numerals.

As compared with the conventional construction shown in FIG. 2, the magnetron of the present invention eliminates use of the spacer 19, the slider 23 and the microwave shielding choke 22. In place, the magnetron comprises a disc-shaped spacer 30 fitted in a coupling area between the F-seal 4 and the lower pole piece 11' in accordance with the present invention, as shown in FIG. 2. Over the upper surface of the spacer 30, a metal coating 33 is provided in a proper thickness and thus defines an attenuation cavity 36, together with the lower pole piece 11'. The metal coating 33 is in contact with the lower pole piece 11' and thus electrically connected to the ground, via the magnetron body.

In place of the metal coating 33, alternatively, other metal plate members may be used which serve the same function as that of the metal coating.

The spacer 30 has at its proper portions a pair of lead holes 31 and 32 through which the center lead 17 and the side lead 18 extend, respectively. At the metal coating 33, insulating portions 34 and 35 for insulating the leads 17 and 18 from each other are provided around the lead holes 31 and 32, respectively. Each insulating portion 34 (or 35) may be provided by removing an area corresponding to the insulation portion from the metal coating 33 and has a radius larger than that of each lead hole 31 (or 32), by a predetermined dimension L.

It is preferred that the predetermined dimension L is not less than 0.1 mm.

The spacer 30 also has a taper shape at its peripheral portion so that it can be held in position by fitting the tapered peripheral portion in the coupling area between a curved portion of the F-seal 4 and the lower pole piece 11'.

The operation of the magnetron which has the above-mentioned construction including the spacer 30 and the metal coating 33 in accordance with the present invention will now be described in detail.

As electric power is applied to the filament 2 via the center lead 17 and the side lead 18, the filament 2 emits thermions. The emitted thermions are radiated into the interaction space 9 and conduct an accelerated rotation therein, by axial magnetic fluxes generated from the pole pieces 11 and 11' and an electric field generated between the filament 2 and the vane 7. On the other hand, microwave energy transmitted to the vane 7 is fed into the cooking chamber, via the antenna feeder 8 and a waveguide (not shown) of the oven, thereby heating the food placed in the cooking chamber.

Figure 1:
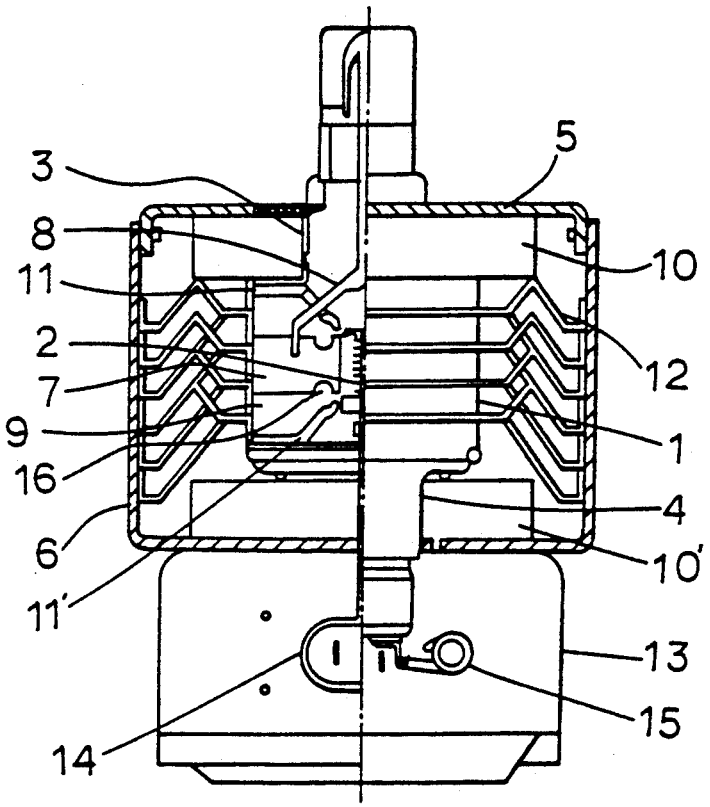
Fig. 1 PRIOR ART
FIG. 1 is a partial sectional view of a conventional magnetron for a microwave oven.

At this time, microwaves may be leaked into the interior of the filter box 13 (shown in FIG. 1) via the center lead 17 and the side lead 18, due to an oscillation of the magnetron. These leaked undesirable microwaves are resonated and thus attenuated by the attenuation cavity 36 which is defined by the lower pole piece 11' and the metal coating 33 formed on the spacer 30.

As a result, the harmful higher harmonics radiated between the lower pole piece 11' and the F-seal 4 and leaked along the F-ceramic member 21 can be shielded, thereby avoiding the microwaves from being leaked outwardly of the filter box 13.

The spacer 30 also functions to transfer heat transmitted to the choke coil 15 (shown in FIG. 1) via the center lead 17 and the side lead 18, to the F-seal 4. Accordingly, it is possible to prevent a phenomenon that a coating formed on the choke coil 15 is oxidized.

Although a vibration occurs by the oscillation of magnetron, both the center lead 17 and the side lead 18 maintain their space in that they are held in position by means of the lead holes 31 and 32 formed in the spacer 30.

In particular, simultaneous lateral vibrations of both the leads 17 and 18 can be avoided, since the spacer 30 is firmly fitted in the coupling area between the F-seal 4 and the lower pole piece 11'.

Figure 5A:
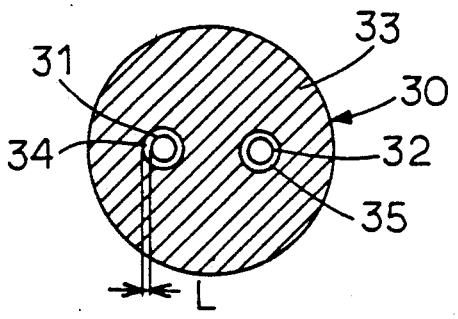
FIGS. 5A and 5B are a plan view and a sectional view of a magnetron according to another embodiment of the present invention, respectively.
Figure 5B:
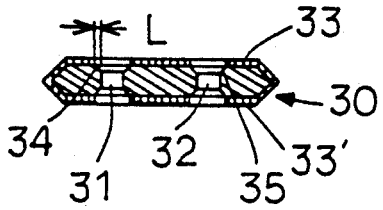
Figure 6A:
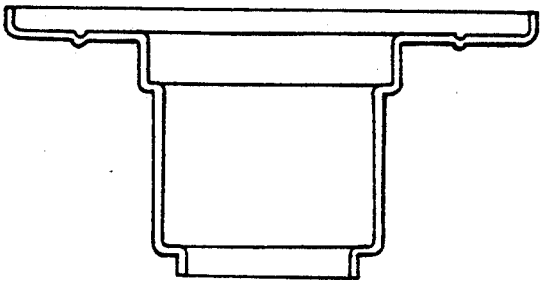
Figure 6B:
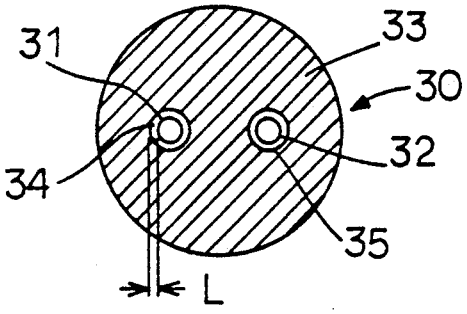
Figure 6C:
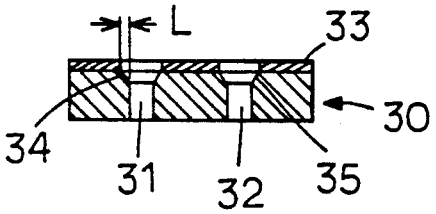
Figure 6D:
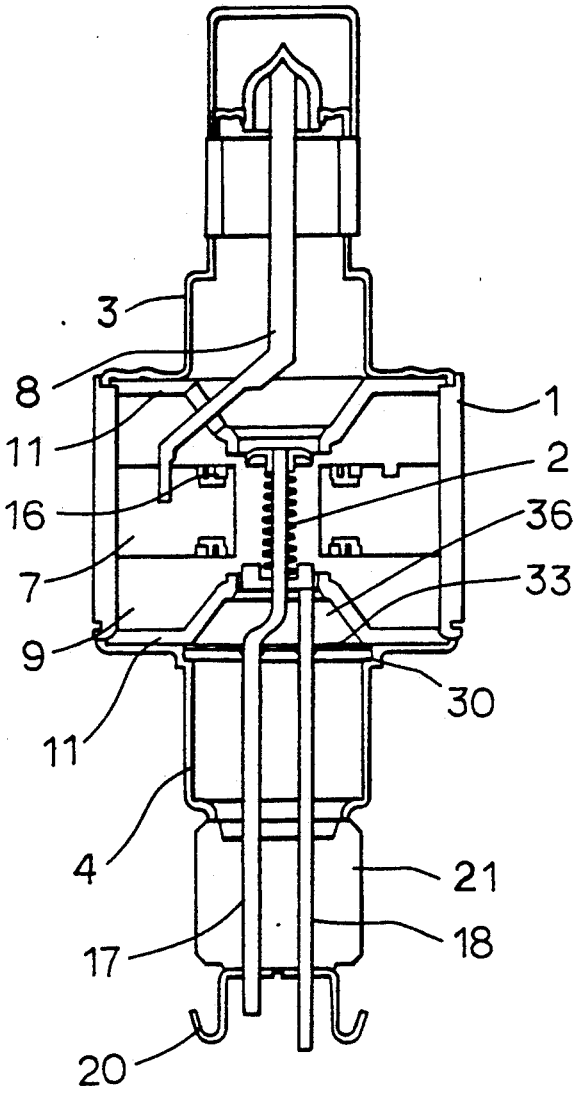

On the other hand, FIGS. 5A and 5B illustrate a plan view and a sectional view of a magnetron according to another embodiment of the present invention, respectively. The magnetron of this embodiment has the same construction as that of the above-mentioned embodiment, except that an additional metal coating 33' is formed at the lower surface of the spacer 30 which has at its upper surface the metal coating 33.

The magnetron of this embodiment can enhance more effectively the microwave shielding effect, in that the spacer 30 has metal coatings 33 and 33' at both surfaces thereof.

Referring to FIGS. 6A to 6D, there is illustrated a part of a magnetron according to another embodiment of the present invention. In this case, the spacer 30 has a vertical peripheral portion which is perpendicular to both upper and lower surfaces of the spacer 30. Correspondingly, the F-seal 4 has at its curved portion a step adapted to support the spacer 30 thereon.

This construction makes it possible to fix easily the spacer 30. In this embodiment, the spacer 30 may have the metal coating only at its upper surface or metal coatings at both upper and lower surfaces. It is also possible to use a metal plate or metal plates, in place of the metal coating or metal coatings.

As apparent from the above description, the present invention provides a spacer which has a metal coating at its upper end or metal coatings at both upper and lower surfaces and thereby achieves an improvement in anti-leakage of microwaves. Since the spacer is also firmly fitted between the lower pole piece and the curved portion of F-seal, vibrations, in particular, lateral vibrations of the leads can be effectively avoided. The fitting of the spacer having a disc shape can also be easily accomplished by a simple work, without using separate jig or sleeves. Accordingly, there is an improvement in workability in the manufacture.

Although the preferred embodiments of the invention have been disclosed for illustrative purposes, those skilled in the art will appreciate that various modifications, additions and substitutions are possible, without departing from the scope and spirit of the invention as disclosed in the accompanying claims.

What is claimed is:

1. A magnetron for a microwave oven comprising:

a shield body;

a center lead and a side lead both extending throughout said shield body;

upper and lower pole pieces coupled to upper and lower portions of the shield body, respectively, and defining an interaction space therebetween;

an F-seal for supporting said lower pole piece;

a spacer fitted in a mounting area defined between said F-seal and the lower pole piece and provided with a pair of lead holes through which said center lead and said side lead extend, respectively; and a metal coating provided at the upper surface of said spacer and adapted to define an attenuation cavity, together with the lower pole piece.

2. A magnetron for a microwave in accordance with claim 1, wherein said metal coating has a pair of insulating portions for insulating the center lead and the side lead from each other.

3. A magnetron for a microwave in accordance with claim 2, wherein each of said insulating portions has a radius which is larger than that of each corresponding one of said leads, by at least 0.1 mm.

4. A magnetron for a microwave in accordance with claim 1, wherein said spacer is a disc having a tapered peripheral portion.

5. A magnetron for a microwave in accordance with claim 1, wherein said magnetron further comprises an additional metal coating provided at the lower surface of said spacer.

6. A magnetron for a microwave in accordance with claim 1, wherein said spacer has a vertical peripheral portion which is perpendicular to both the upper and lower surfaces of the spacer and correspondingly, said F-seal has a step for supporting the spacer thereon.

* * * * *